US012576319B2

(12) United States Patent
Rinicella, Sr. et al.

(10) Patent No.: US 12,576,319 B2
(45) Date of Patent: Mar. 17, 2026

(54) SOUND-DAMPENING PAD FOR A PADDLE

(71) Applicants: Dan Rinicella, Sr., Aurora, OH (US); Timothy S. Garner, Medina, OH (US)

(72) Inventors: Dan Rinicella, Sr., Aurora, OH (US); Timothy S. Garner, Medina, OH (US)

( * ) Notice: Subject to any disclaimer, the term of this patent is extended or adjusted under 35 U.S.C. 154(b) by 9 days.

(21) Appl. No.: 18/763,565

(22) Filed: Jul. 3, 2024

(65) Prior Publication Data

US 2025/0269252 A1 Aug. 28, 2025

Related U.S. Application Data

(60) Provisional application No. 63/556,484, filed on Feb. 22, 2024.

(51) Int. Cl.
*A63B 59/42* (2015.01)
*A63B 60/54* (2015.01)
*A63B 102/08* (2015.01)

(52) U.S. Cl.
CPC ..... *A63B 59/42* (2015.10); *A63B 60/54* (2015.10); *A63B 2102/08* (2015.10)

(58) Field of Classification Search
CPC ..... A63B 59/42; A63B 60/54; A63B 2102/08
See application file for complete search history.

(56) References Cited

U.S. PATENT DOCUMENTS 11,925,843 B1 3/2024 Bicanic
2014/0309059 A1 10/2014 Minch
2016/0107053 A1* 4/2016 Pree ..... A63B 59/42 473/529
2017/0136325 A1 5/2017 Fox et al.
2018/0104555 A1 4/2018 Taylor
2021/0260452 A1 8/2021 Zheng
2022/0249928 A1 8/2022 Condez et al.
2023/0191215 A1 6/2023 Barnes et al.
2023/0201672 A1 6/2023 You
2023/0249042 A1 8/2023 Barnes et al.
2024/0252893 A1* 8/2024 Bicanic ..... A63B 59/45
2024/0390753 A1* 11/2024 Haugom ..... A63B 49/02
2024/0424366 A1* 12/2024 Li ..... A63B 59/48

OTHER PUBLICATIONS

Zhang, M, (Sep. 25, 2023), USA Pickleball announces quiet category for pickleball products | USA Pickleball, USA Pickleball, https://usapickleball.org/news/usa-pickleball-announces-quiet-category-for-pickleball-products/.

Owl Sport, (Nov. 14, 2023), OWL Sport, an Innovative New Sports Company Disrupting the Exploding Pickleball Industry, Addresses Pickleball Noise with Game-Changing Quiet Paddle, PR Newswire, https://www.prnewswire.com/news-releases/owl-sport-an-innovative-new-sports-company-disrupting-the-exploding-pickleball-industry-addresses-pickleball-noise-with-game-changing-quiet-paddle-301988166.html.

Justpaddles, (Jan. 18, 2024), The Top 7 best quiet Pickleball Paddles, JustPaddles, https://www.justpaddles.com/blog/post/best-quiet-pickleball-paddles/.

* cited by examiner

*Primary Examiner* — Jeffrey S Vanderveen

(57) ABSTRACT

A sound-dampening pad for a paddle used in a paddle sport that uses a ball, the pad including a cushion material disposed on a first side of the pad; an adhesive disposed on a second side of the pad configured to attach the pad the paddle; wherein the cushion material reduces the sound of the paddle striking the ball.

15 Claims, 6 Drawing Sheets

SOUND-DAMPENING PAD FOR A PADDLE

BACKGROUND OF THE INVENTION

The sport of pickleball has grown in popularity, which has resulted in numerous pickleball courts being constructed, often near residential areas. Some residents have complained about the noise that comes from a hard pickleball paddle striking a hard pickleball. This has lead to some cities passing noise ordinances regarding pickleball.

In addition, the national pickleball governing body has recently created a "quiet category" of pickleball that uses any number of techniques to reduce the noise resulting from playing pickleball. This includes paddles that are constructed from different materials than regular pickleball paddles, or paddles that have permanent padding as part of their construction as well as balls and accessories, such as paddle covers/sleeves/overlays. Thus, there exists a need for a quieter pickleball paddle.

BRIEF SUMMARY OF THE INVENTION

The invention relates to an acoustic fabric pad affixed to a paddle to reduce sound. In particular, the invention is directed to a pad for a pickleball paddle, but is not limited to such use, and could adapted for any paddle sport that creates noise from striking a ball with a paddle.

A exemplary sound-dampening pad for a paddle used in a paddle sport that uses a ball, the pad includes a cushion material disposed on a first side of the pad; an adhesive disposed on a second side of the pad configured to attach the pad the paddle; wherein the cushion material reduces the sound of the paddle striking the ball.

The sound dampening pad can include a pad that is releasably attached to the paddle.

The sound dampening pad can include a pull tab disposed at an edge of the pad for removing the pad from the paddle.

The sound dampening pad can include the pull tab being disposed at a bottom edge of the pad at the top of the handle of the paddle.

The sound dampening pad can include the paddle being a pickleball paddle.

The sound dampening pad can include the cushion material being a polymer.

The sound dampening pad can include the cushion material being a polyester PET acoustic fabric.

The sound dampening pad can include wherein the pad reduces the sound of the paddle striking the ball by 25% or more.

The sound dampening pad can include wherein the pad reduces the sound of the paddle striking the ball by 40% or more.

The sound dampening pad can include wherein the pad reduces the sound of the paddle striking the ball by 50% or more.

An exemplary sound-dampening system for a paddle sport that uses a ball and paddle having first and second striking surfaces, the system including first and second pads, each pad including a cushion material disposed on a first side of the pad; an adhesive disposed on a second side of the pad configured to attach the pad to the paddle; wherein the first pad is attached to the first striking surface of the paddle, and the second pad is attached to the second striking surface of the paddle; wherein the cushion material reduces the sound of the paddle striking the ball.

The sound-dampening system can include pads that are removeable.

The sound-dampening system can include a storage board configured to releasably hold the pads.

The sound-dampening system can include the storage board having first and second opposing sides, each of the opposing sides having a low surface energy layer, whereby when storing the pads, the low surface energy layer is disposed between the pad and the storage board.

The sound-dampening system can include the low surface energy layer being a silicone layer.

DETAILED DESCRIPTION OF THE INVENTION

Figure 1:
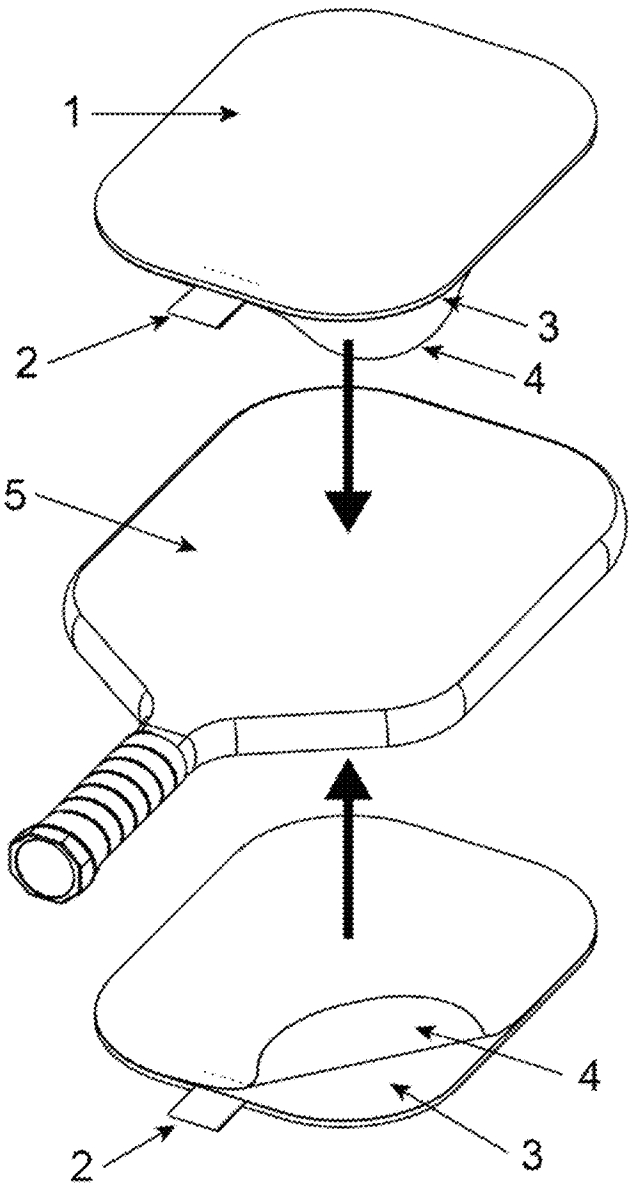
FIG. 1 is an exploded perspective view of an exemplary embodiment of the sound absorbing pad and paddle.
Figure 1:
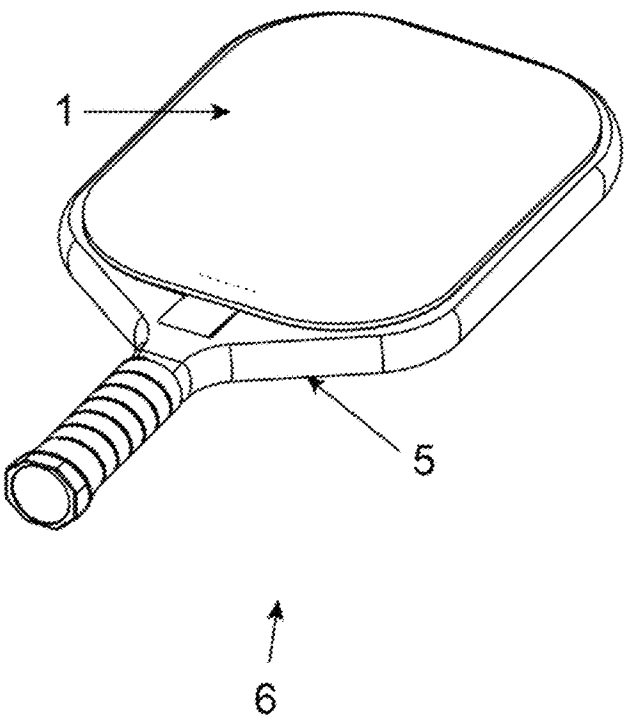

The invention relates to an acoustic fabric pad affixed to a paddle to reduce sound. In particular, the invention is directed to a pad for a pickleball paddle, but is not limited to such use, and could adapted for any paddle sport that creates noise from striking a ball with a paddle. The present invention allows a normal pickleball paddle to be adapted to conform to the quiet category requirements, and/or to otherwise reduce the noise generated from striking a ball.

The present invention is a pair of pads that can be affixed to both striking surfaces of a standard pickleball paddle. The pad is composed of sound-dampening padding or cushion material. The padding material can vary—including type, shape, thickness, and density. The padding material can include, e.g., polyester PET acoustic fabric, but is not limited to such materials. By incorporating acoustic materials, the pad absorbs and dampens the sound produced upon impact with the ball, resulting in a quieter playing experience. With noise ordinances and court restrictions on the rise, the present invention addresses these issues.

The pad of the present invention was tested on various paddles with and without the acoustic pad. The results showed that the decibel noise levels were reduced by up to 50% when the pad was installed.

The pad is attached to a user's existing standard pickleball paddle, so there is no need to buy an expensive separate paddle to use when noise is an issue. Thus, the user can choose to use the pad when it is needed. The pad is designed for easy attachment to the paddle, requiring minimal effort for installation and removal, allowing players to change their equipment quickly.

The pad uses a removable adhesive backing that allows the pad to be attached and removed numerous times without leaving a messy residue. This allows a user to play with reduced sound or remove the pad and use the paddle as a standard paddle in a standard pickleball game. The padding material has adhesive backing. A permanent adhesive applied to back of the padding material that is removable and/or re-positionable. This way, the padding can be applied and removed multiple times.

The adhesive is covered with a removable protective covering prior to use (such as, e.g., wax paper). In use, the cover layer is removed, exposing re-positionable adhesive on the side that is applied to paddle. The adhesive allows the padding to be applied and removed multiple times.

The pad is customizable and can be designed to fit various paddle sizes and shapes, ensuring compatibility with different models and preferences. The pad can be modified to a wide range of colors and designs, allowing the user to choose what he or she likes best. The pad is constructed with high-quality materials, the acoustic fabric pad is durable and long-lasting, providing reliable performance over extended use.

The pad is suitable for players of all skill levels, the acoustic fabric pad can be used in various playing conditions, whether indoors or outdoors. Reduced noise levels enable players to concentrate better on their game, enhancing focus and precision in every shot. Quieter gameplay creates a more enjoyable experience for players and reduces disturbance to others nearby, fostering a more peaceful environment for everyone around. The pad is tested and approved by the USA Pickleball Association for the Quiet Category.

Referring now to the drawings, FIG. 1 shows the sound dampening system 6. The sound dampening system includes pad 1 applied to a paddle 5. The user can add a pad 1 to the faces of a pickleball paddle 5 to quiet the sound when the paddle 5 makes contact with the ball. The pad 1 can be either permanently installed onto the paddle or it may be removeable and re-usable multiple times depending on the type of double-sided adhesive 3 used. An exemplary adhesive is double-sided Repositionable Tape 9425 from 3M, with a high tack permanent adhesive on one side and a medium tack repositionable adhesive on the other side. Other adhesives can include Repositionable Tapes 665, 666, 9415PC, 9416, 9425HT, and 9449S, from 3M. The inventors found through testing that the best results were to have one side of the double-sided adhesive 3 be permanent adhesive that sticks onto the pad material, and the other side of the adhesive 3 that sticks onto the paddle is a re-positionable non-permanent adhesive 3 so that the pad 1 can be removed and reused multiple times.

The pads can be part of a system that includes a removable backer paper 4 installed to keep the adhesive 3 protected until first use. Once installed on the paddle 5, the inventors found that users need a method to aid in removal of the pad 1 so that it's not so hard to lift the pad 1 up and away from the paddle 5. To facilitate this, a pull tab 2 is included to help aid in an easier removal of the pad 1. Through testing, the inventors found that the pull tab 2 works best if the tab 2 is permanently affixed to the pad 1. The pull tab 2 can be made from a separate material that is attached to the pad 1 (e.g., sewed or glued to the pad 1), or the tab 2 can be made as part of the pad 1 itself. FIG. 1 shows the tab 2 located at the bottom of the pad 1, but the tab 2 can be located around any of the sides of the pad 1.

Figure 2:
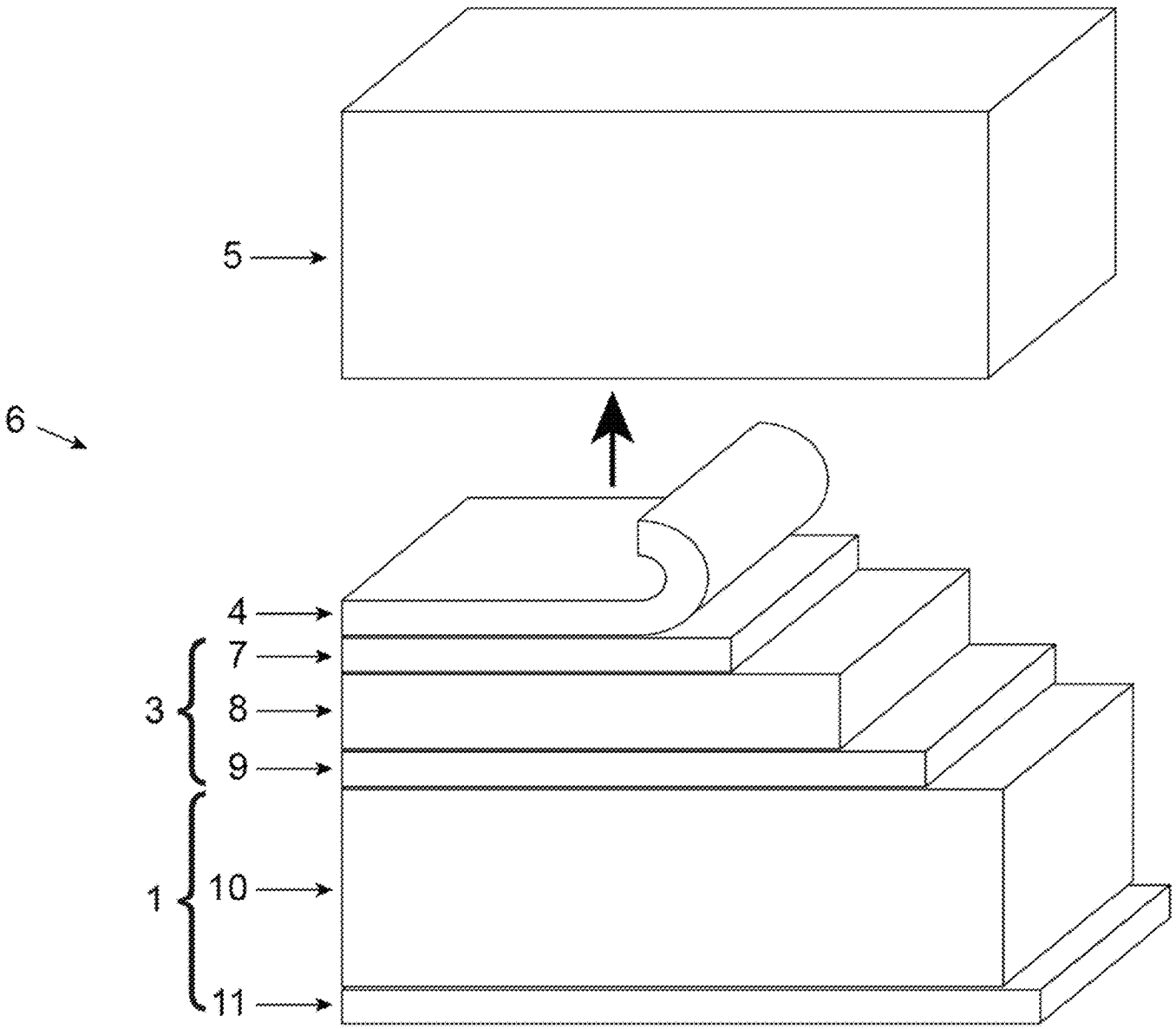
FIG. 2 is a cross sectional side view of the pad and paddle of FIG. 1.

FIG. 2 shows the pad 1 and adhesive layers detail. The layers are not shown to scale for ease of illustration and explanation. FIG. 2 shows how the pad 1 and adhesive 3 layers are constructed. The pad 1 includes a main pad body or substrate 10 that is constructed of an acoustic polyester fabric material. The substrate can have a thickness between 2 mm and 8 mm, and can have a density between 200 g/m$^2$ and 3000 g/m$^2$. An exemplary embodiment has a density of 600 g/m$^2$ density and a 4 mm thickness. The pad can be constructed from several different materials, including but not limited to, polyester, PET, acoustic fabric, felt, wool, flocking, cotton, cork, rubber, neoprene, and/or foam, and combinations thereof. The face of the pad can optionally include graphics 11. The graphics 11 can be added by several methods, including but not limited to, digital printing, silk screen printed, offset printed, hot stamping, dying, painted, and/or stitched. The permanent side 9 of the double-sided adhesive 3 is applied onto the pad, with the next layer being the carrier film backing 8, then the re-positionable adhesive layer 7, and then the removable release liner paper 4 that is typically thrown away once removed but could be kept and re-used. The pad is adhered to a paddle 5 by removing the paper release liner (if applicable) and placing the re-positionable adhesive 7 onto the paddle 5.

Figure 3:
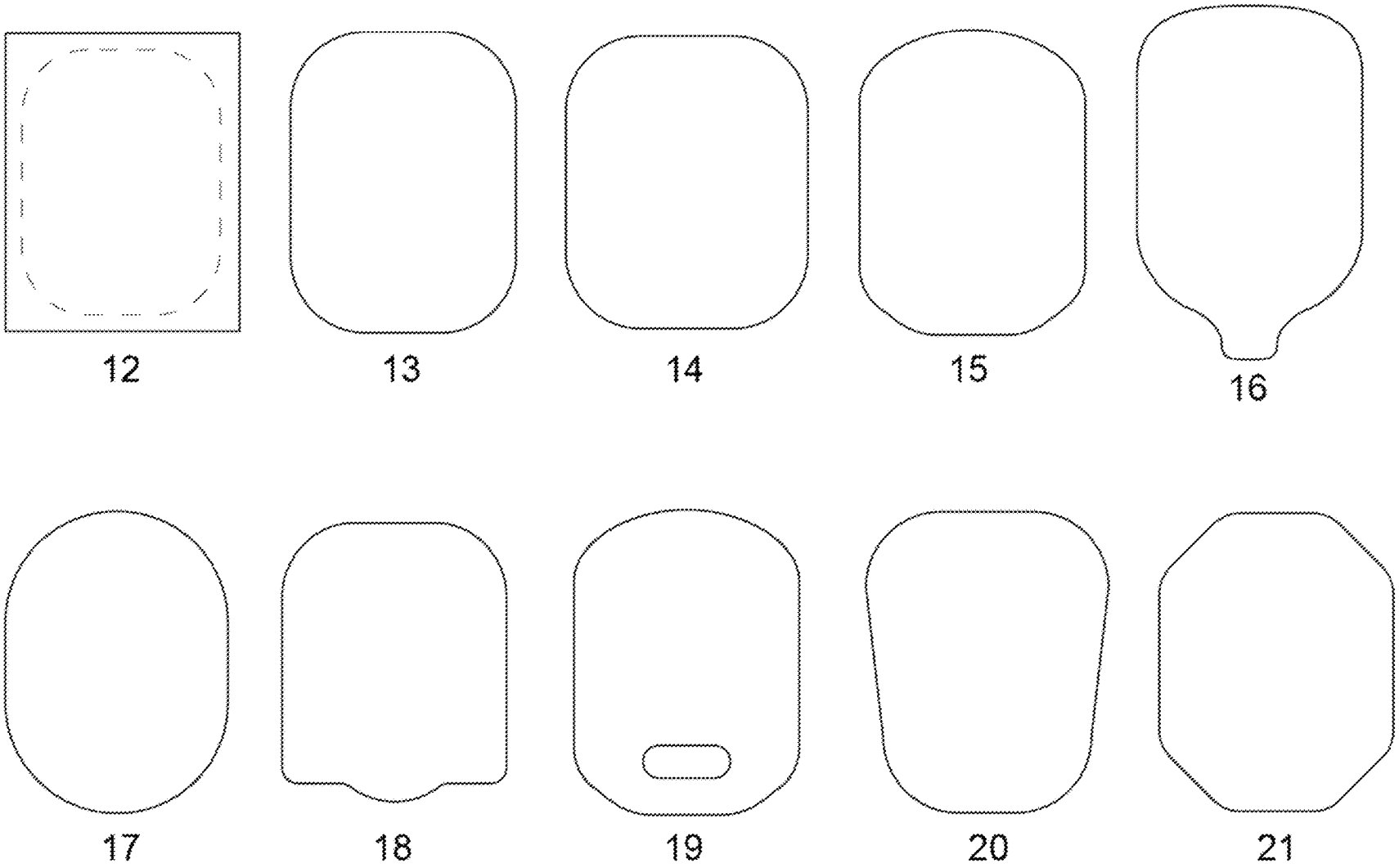
FIG. 3 shows alternate exemplary embodiments of the shape of the sound absorbing pad.

As can be seen in FIG. 3, several possible shapes to match or closely match the wide range of paddles currently on the market today. In a rudimentary embodiment, the pad 5 be a rectangular sheet that would allow the user to cut the pad material to match the user's paddle shape 12. However, this is less preferred since the hand-cut shape will be aesthetically unpleasing. Preferred precision cut shapes include a rectangle with radiused corners 13, a square with radiused corners 14, and a rectangle with rounded top 15. These shapes 13-15 cover the vast majority of paddles currently available on the market today. Additional shapes can be produced (including but not limited to e.g. pad shapes 16-21), as well as customized shapes for individual users.

Figure 4:
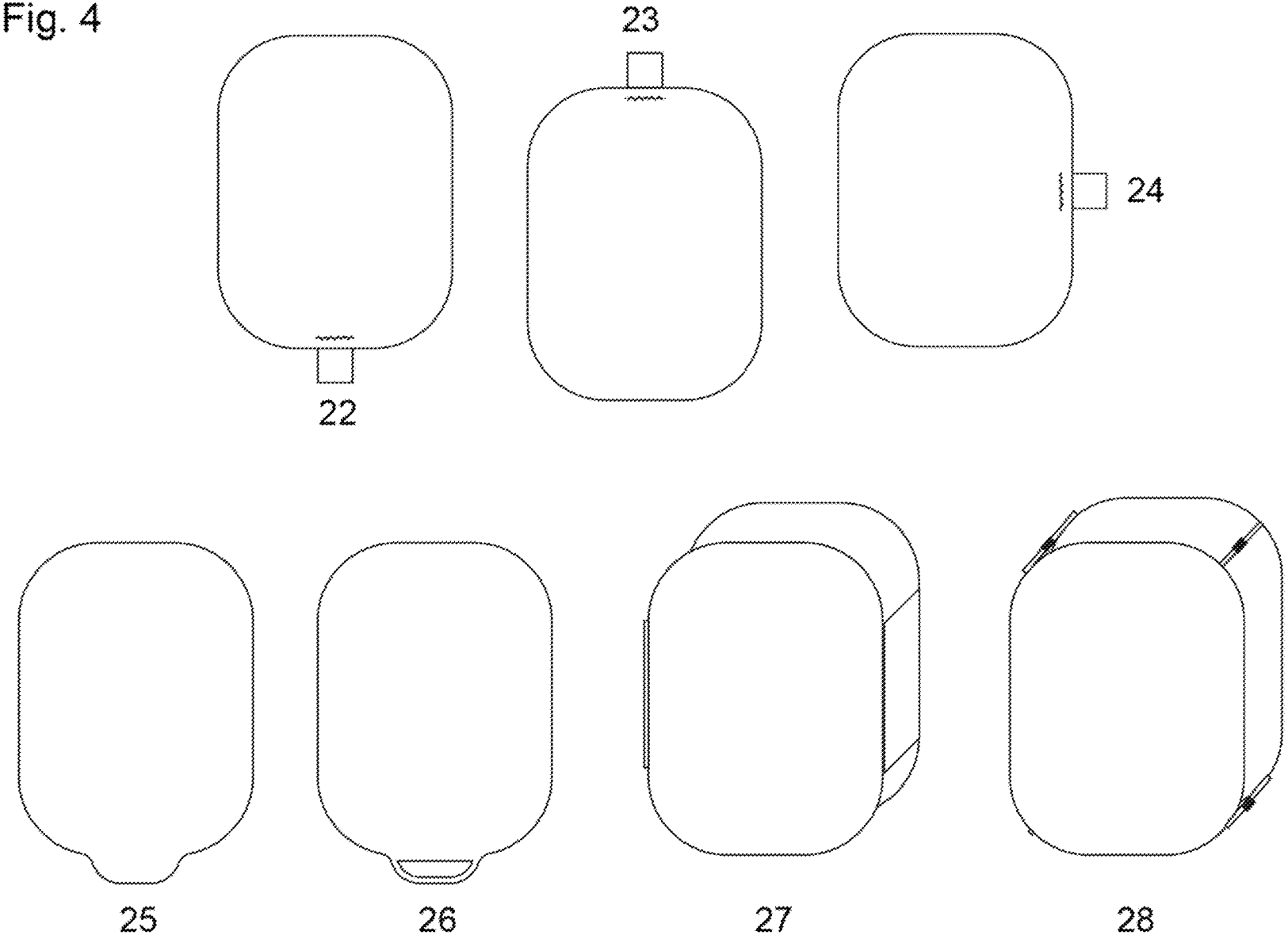
FIG. 4 shows alternate exemplary embodiments of the pull tab of the sound absorbing pad.

FIG. 4 shows various exemplary embodiments of pull tab 2 attachment arrangements. The pad 1 can be affixed to the paddle 5 is several ways. The pull tab 2 used to remove the pad 1 from the paddle 5 can be configured in multiple ways. An exemplary embodiment can include using adhesive or glue. Further exemplary embodiments include placing the pull tab 2 along the bottom 22, on the side 23, or on the top 24. When the tab 2 is positioned along the bottom 22, the tab is situated just above the handle of the paddle 5 (as can be seen in FIG. 1). The tab can be integrated or intrinsic with the sheet of the pad 1 as a solid tab 25, or having a band attached 26 made of from rope, string, nylon, silicone, rubber, elastic material, or a rigid material with or without a finger hole cutout. The pad can be formed into a single elastic sleeve 27 that attaches both pads together and slides over the paddle 5. The pad can be formed with bands or adjustable straps 28 that attach the two pads together and onto paddle 5. Further, the pad 1 can be affixed using magnets, screws, zippers.

Figure 5:
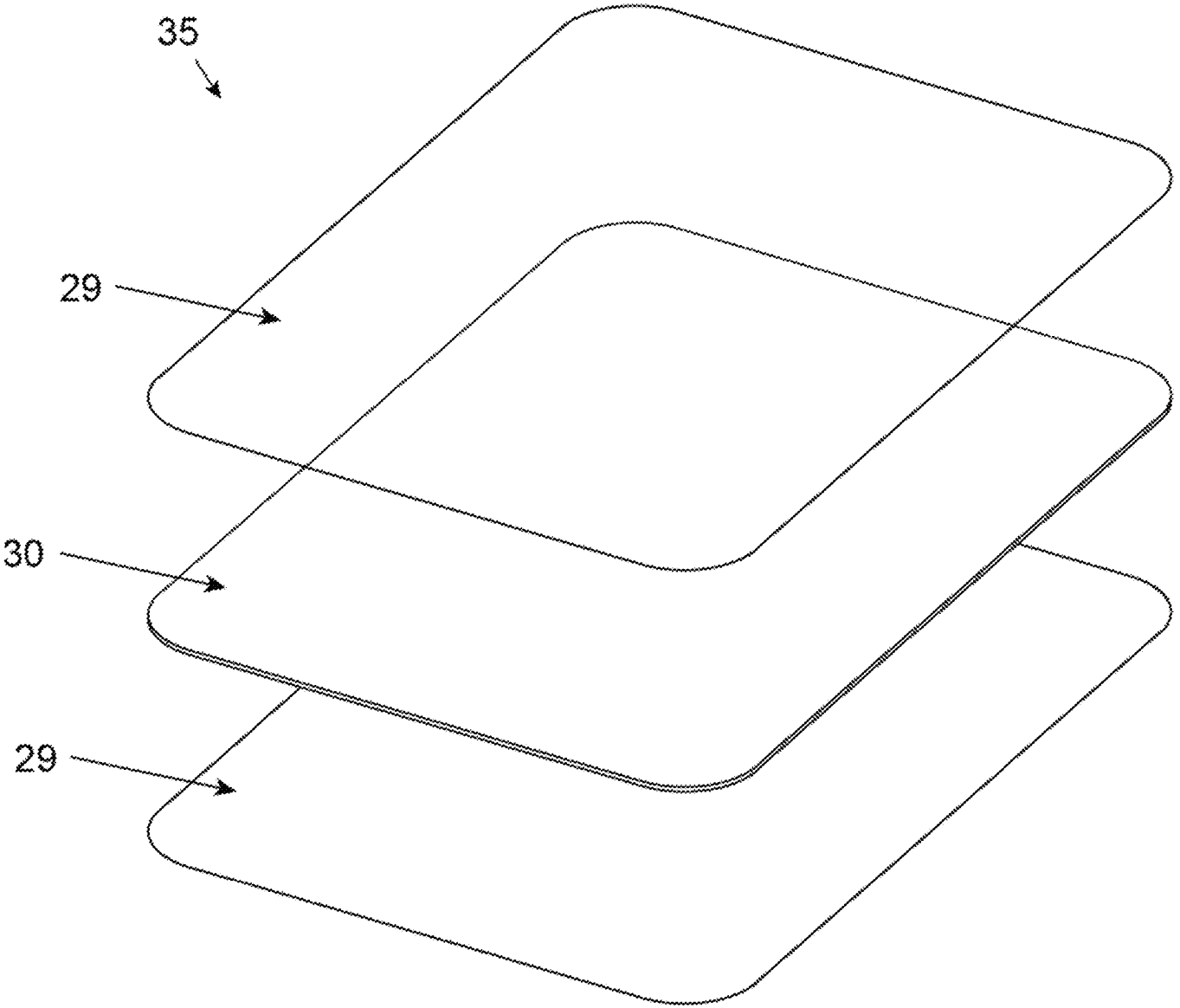
FIG. 5 is an exploded perspective view an exemplary embodiment of a storage board for the sound absorbing pad.

FIG. 5 shows an exemplary storage system for the removeable pads 35. The storage board 30 is a reuseable device for storing the pads between use to keep the pads and adhesive protected from any damage so that it increases the longevity of the pads 1 and adhesive 3.

When the pads 1 are adhered to the board it prevents things like dust/dirt/fuzz/hair/debris from collecting on the adhesive and reducing its tackiness over time. The pads 1 can be attached to opposing sides (i.e. both sides) of a single board such that when the pads are releasably affixed to the board, just the pad faces are exposed. Some other possible storage options could include a bag, case or protective sleeve.

An exemplary use case includes if a user wants to play pickleball and noise is not an issue, the pads are stored on the storage board. If the user wants to play a quieter game of pickleball (for example, if neighbors complain about the noise from the ball hitting the paddle), the user can remove the pads from the storage board, apply the pads to the user's paddle and play with reduced noise. Later, if the noise is not an issue, the user can remove the pads from the paddle and reapply the pads to the storage board to preserve the adhesive for future use.

The board can be made from a rigid or flexible material of varying thicknesses. Exemplary materials include, but are not limited to, paper, card stock, cardboard, plastic, ABS, PVC, polystyrene, plexiglass, fluted plastic, silicone, rubber, cork, foam, neoprene, etc. A preferred embodiment includes either a card stock paper board since these were found to be effective and economical. An exemplary board includes a paper card stock in 50 pt thickness (1.3 mm) and 1000 g/m$^2$ density.

To help keep the adhesive 3 working properly and avoid damage aside from normal use, the adhesive 3 needs to be adhered to a low surface energy surface 29 so that it can be easily released. The inventors tried several materials, starting with standard glossy and matte laminated surfaces. This was determined to be less than ideal because the adhesion of the adhesive was very strong and damaged the pad as well as the card stock paper material underneath. Polystyrene without any lamination was tested and the adhesion was found to be still very strong, but the polystyrene material was not damaged during removal of the adhesive pad. Silicone was found to provide a low surface energy surface 29 to which the adhesive can stick, but from which also easily be removed. As a result, there is no damage to the adhesive, the pad, or the board material.

The silicone 29 can be applied in several methods, including but not limited to, printing, painting, spraying, and film laminating. An exemplary embodiment includes screen printing a clear UV cured ink with a silicone additive. An alternate exemplary embodiment includes a clear silicone film laminate that uses a solvent-based silicone oil applied onto 25 μm thickness PET carrier film material with acrylic glue on the backside. This silicone film laminate is applied by a laminating process as a top layer onto both sides of the paper card stock storage board. The end product results in a storage board to which the pads can stick, yet be easily removed without any damage to any of the materials used, thus, prolonging the product's lifespan.

The storage board can include optional graphics, line drawings, or lettering. The graphics may be printed directly onto the board 30 surface by digital, offset, or screen printing, or an applied layer such as a vinyl decal. A preferred exemplary embodiment includes direct offset printing applied to both sides of the storage board 30.

The storage board 35 can be formed in various dimensions, but the overall size is preferred to be close in size to the removeable pad 1 to keep the board compact and make good use of space when storing or traveling. An exemplary embodiment includes using a size A4 (8.27" w×11.69" h) (210.05 mm×296.92 mm). An exemplary storage board paper cardstock includes a 50 point thickness (1.3 mm) and 1000 g/m$^2$ density.

Figure 6:
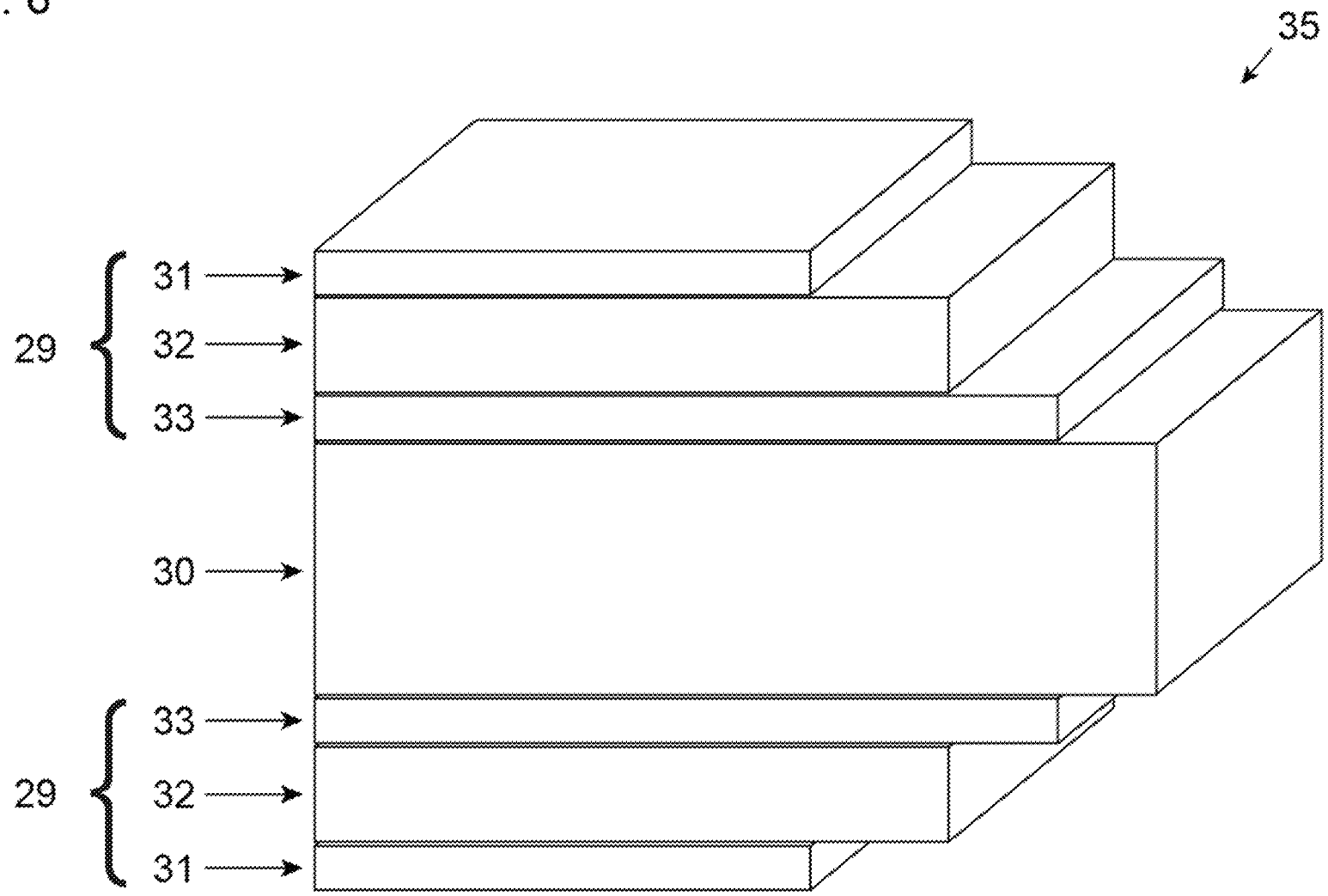
FIG. 6 is a cross sectional side view of the storage board of FIG. 5.

FIG. 6 shows the layers of the storage board 35 in more detail. The layers are not shown to scale for ease of illustration and explanation. An exemplary embodiment includes a double-sided storage board layers with a silicone film laminate top layer 31, a 25 um thickness polyethylene terephthalate (PET) or unplasticized polyvinyl chloride (UPVC) carrier film backing 32, permanent acrylic cold pressed adhesive 33, and paper cardboard substrate 30 of 50 pt thickness and 1000 g/m$^2$ density.

Although the invention has been shown and described with respect to certain embodiments, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment of the invention.

What is claimed is:

1. A sound-dampening pad for a paddle used in a paddle sport that uses a ball, comprising:

an acoustic cushion material layer composed of PET polyester felt fabric disposed on a first side of the pad, having a thickness between 2 mm and 8 mm and a density between 200 g/m$^2$ and 3000 g/m$^2$, wherein an exemplary embodiment has a 4 mm thickness and 600 g/m$^2$ density, said material being specifically designed and tested to achieve at least 50% measurable reduction in sound generated when a pickleball ball impacts the surface of a standard pickleball paddle;

wherein the acoustic pad is removably attachable via a repositionable double-sided differential adhesive backing disposed on a second side of the pad configured to attach the pad directly onto the existing exterior face of any commercially available pickleball paddle without replacing or altering the paddle's original surface;

wherein the pad is reusable, maintaining effective adhesion and acoustic performance through multiple cycles of removal and reapplication;

wherein the acoustic pad is offered in a variety of geometrical shapes and sizes to accommodate different commercially available pickleball paddles, and is further available in multiple color options and printed graphic designs to allow the user to select a visually preferred configuration.

2. The sound dampening pad of claim 1, wherein said acoustic pad comprises a repositionable double-sided differential adhesive backing specifically configured for repeated manual removal and reapplication multiple times without loss of adhesion or acoustic performance, directly onto the existing face of any commercially available pickleball paddle, without the requirement of any removal tool, adhesive applicator, adhesive removal device, or surface preparation, and without modifying, replacing, or discarding the existing paddle surface.

3. The sound dampening pad of claim 1, further comprising a removal aid in the form of a rigid or semi-rigid strip affixed near one edge of the pad, wherein said strip does not extend beyond the outer perimeter of the pad and is positioned to create a liftable edge zone to facilitate manual removal of the pad from the paddle.

4. The sound dampening pad of claim 3, wherein the removal aid is initially positioned along the bottom edge of the pad, and wherein said bottom edge corresponds to the edge of the pickleball paddle nearest the handle when installed, such that the removal aid remains concealed beneath the pad during use and may optionally be repositioned to the side or top edges depending on user preference or paddle configuration without interfering with gameplay.

5. The sound dampening pad of claim 1, wherein said pad is manufactured in a variety of geometrical shapes and sizes for compatibility with commercially available pickleball paddles, and further offered in multiple colors and printed decorative designs to allow user customization, wherein the pad is temporarily attachable to the surface of any such paddle, including but not limited to those conforming to USA Pickleball Association specifications, without requiring modification or replacement of the paddle structure.

6. The sound dampening pad of claim 1, wherein the cushion material comprises a compressible polymer-based felt, having a thickness between 2 mm and 8 mm and a density between 200 g/m$^2$ and 3000 g/m$^2$, said material being selected for acoustic dampening properties and configured to reduce impact noise when removably adhered to the surface of any existing commercially available pickleball paddle.

7. The sound dampening pad of claim 1, wherein the cushion material comprises a compressible polyester-based PET acoustic felt, having a thickness between 2 mm and 8 mm and a density between 200 g/m$^2$ and 3000 g/m$^2$, configured to absorb impact energy and reduce noise when adhered to a pickleball paddle surface.

8. The sound dampening pad of claim 1, wherein the pad reduces the sound of the paddle striking the ball by approximately 25% or more, as measured by standardized acoustic testing.

9. The sound dampening pad of claim 1, wherein the pad reduces the sound of the paddle striking the ball by approximately 40% or more, as measured by standardized acoustic testing.

10. The sound dampening pad of claim 1, wherein the pad reduces the sound of the paddle striking the ball by approximately 50% or more, as measured by standardized acoustic testing.

11. A sound-dampening system for a paddle sport that uses a ball and a paddle with opposing first and second striking surfaces, the system comprising:

a first and a second sound-dampening pad, each pad comprising:

a cushion layer composed of compressible PET acoustic felt disposed on a first side of the pad;

a repositionable adhesive backing layer disposed on a second side of the pad, configured to removably adhere each pad to the respective striking surface of a commercially available pickleball paddle;

wherein each pad is configured to reduce the sound generated when the ball strikes the paddle by at least 50%, as verified through standardized acoustic testing;

and wherein the system is configured to allow both pads to be removed and reapplied repeatedly without permanent modification to the paddle;

wherein the pad comprises a symmetrical pair of matching pads for each side of the paddle;

wherein the cushion material comprises a compressible acoustic felt with a thickness between 2 mm and 8 mm and a density between 200 g/m$^2$ and 3000 g/m$^2$, reduces the sound of the paddle striking the ball.

12. The sound-dampening system of claim 11, wherein each of the first and second pads are removably affixed to the respective striking surface of the paddle via a repositionable double-sided differential adhesive, allowing repeated removal and reapplication without degrading the acoustic performance or requiring tools or surface modification, where an exemplary adhesive is double-sided repositionable tape 9425 from 3M with a high tack permanent adhesive on one side and a medium tack repositionable adhesive on the other side.

13. The sound-dampening system of claim 12, further including a reusable storage board made from rigid or flexible material of varying thicknesses, including but not limited to paper, card stock, cardboard, plastic, ABS, PVC, polystyrene, plexiglass, fluted plastic, silicone, rubber, cork, foam, neoprene, etc., where an exemplary board includes paper card stock board in 50 pt thickness (1.3 mm) and 1000 g/m$^2$ density, having first and second opposing surfaces, each configured with a low surface energy layer to releasably and temporarily retain the acoustic pads when not in use, wherein the low surface energy layer facilitates non-permanent adhesion and prevents damage and degradation of the reusable adhesive on the pads during storage.

14. The sound-dampening system of claim 13, wherein the storage board comprises first and second opposing surfaces, each surface coated with a layer of low surface energy material to minimize adhesive bonding strength, whereby when storing the pads, the low surface energy layer is disposed between the pad and the storage board, wherein the low surface energy layer maintains the integrity of the reusable pad adhesive through repeated storage cycles without requiring covering films or added adhesives, and wherein the pads may be releasably affixed to either side of the board without degradation of adhesive or sound-dampening function.

15. The sound-dampening system of claim 14, wherein the low surface energy layer disposed on each surface of the storage board comprises a silicone-based coating or substrate layer configured to prevent adhesive transfer, maintain the integrity of reusable adhesive pads during storage, and facilitate repeated pad application and removal without requiring an intermediary film or protective barrier, where an exemplary embodiment includes a clear silicone film laminate that uses a solvent-based silicone oil applied onto 25 μm thickness PET carrier film material with acrylic glue on the backside, where this silicone film laminate is applied by a laminating process as a top layer onto both sides of the storage board.

* * * * *